United States Patent [19]

Pyrih et al.

[11] 4,258,014

[45] Mar. 24, 1981

[54] PROCESS FOR RECOVERING URANIUM FROM WET PROCESS PHOSPHORIC ACID

[75] Inventors: Roman Z. Pyrih; Robert S. Rickard, both of Golden; Orin F. Carrington, Arvada, all of Colo.

[73] Assignee: Earth Sciences, Inc., Golden, Colo.

[21] Appl. No.: 845,351

[22] Filed: Oct. 25, 1977

[51] Int. Cl.[2] ..... C01G 43/00

[52] U.S. Cl. ..... 423/10; 423/15; 423/17

[58] Field of Search ..... 423/10, 15, 17, 20

[56] References Cited

U.S. PATENT DOCUMENTS

| | | | |
|---|---|---|---|
| 2,859,094 | 11/1950 | Schmitt et al. | 423/10 |
| 2,860,031 | 11/1958 | Grinstead | 423/10 |
| 3,243,257 | 3/1966 | Coleman | 423/10 |
| 3,790,658 | 2/1974 | Fox et al. | 423/18 |
| 3,835,214 | 9/1974 | Hurst et al. | 423/20 |
| 3,836,476 | 9/1974 | Baldwin et al. | 423/10 |
| 4,002,716 | 1/1977 | Sundar | 423/10 |
| 4,105,741 | 8/1978 | Wiewiorowski et al. | 423/10 |

*Primary Examiner*—Edward A. Miller

*Attorney, Agent, or Firm*—Sheridan, Ross, Fields & McIntosh

[57] ABSTRACT

The invention is an improvement in the process for recovering uranyl uranium from solutions in which the uranyl uranium is recovered with an liquid-liquid solvent extraction agent dissolved in an inert solvent, the loaded agent scrubbed with water, the scrubbed agent stripped with ammonium carbonate solution to form a slurry of ammonium uranyl tricarbonate, the stripped agent returned to the liquid-liquid solvent extraction step, and the ammonium uranyl tricarbonate calcined to a uranium oxide product, the improvement which comprises stripping the uranium from the ion exchange agent with an alkali metal carbonate rather than ammonium carbonate, scrubbing the loaded agent with acidified alkali carbonate strip solution prior to stripping, and regenerating the stripped liquid-liquid solvent extraction agent with a mineral acid before return to the liquid-liquid solvent extraction circuit.

3 Claims, No Drawings

PROCESS FOR RECOVERING URANIUM FROM WET PROCESS PHOSPHORIC ACID

BACKGROUND OF THE INVENTION

The present invention relates to an improvement in processes for the recovery of uranium in the uranyl form from solutions. The invention is particularly applicable to processes for the recovery of uranium from wet process phosphoric acid like that disclosed in U.S. Pat. No. 3,835,214. In the process of the patent the uranium is recovered from a phosphoric acid solution resulting from the treatment in the wet process plant of phosphate ore with sulfuric acid to make fertilizer. The feed solution is a phosphoric acid solution containing sufficient uranium to warrant its recovery. In the first liquid-liquid solvent extraction circuit of the process the uranium in the phosphoric acid solution is reduced to uranous form and recovered from the phosphoric acid feed solution on a solvent extraction agent for reduced uranium, and the uranium recovered from the loaded agent by an oxidative strip with phosphoric acid. The uranium in uranyl form is recovered from the strip solution with DEHPA-TOPO liquid-liquid solvent extraction agent and stripped from the agent with ammonium carbonate to form ammonium uranyl tricarbonate which is calcined to form the product uranium oxide. The present invention is applicable to the second stage strip and uses an alkali metal carbonate rather than ammonium carbonate as a stripping agent, all as disclosed in our copending U.S. patent application, Ser. No. 833,247, filed in the U.S. Patent and Trademark Office on Sept. 14, 1977.

In processes for stripping uranyl uranium from ion exchange agents like DEHPA as disclosed in the above-mentioned patent, ammonium carbonate is conventionally used as a stripping agent. Prior to the stripping, the loaded agent is conventionally scrubbed with water. Also, after the liquid-liquid solvent extraction agent is stripped with ammonium carbonate, the agent is conventionally recycled to the extraction step using DEHPA without regeneration or purification.

It has been noted that water scrubbing the DEHPA-TOPO agent in the second circuit of the patent before stripping does not adequately remove such impurities as phosphorus, iron, and vanadium. Use of an ammonium carbonate strip of the oxidized uranium from the agent results in the precipitation of uranium in the strip concentrate solution, thus causing solids accumulation in the strip circuit, and introduces the problem of organic wetting of the yellow cake product.

Recycling of the stripped organic of the second circuit without regeneration presents phase separation problems resulting from emulsions formed with sodium, aluminum, and silicon.

Accordingly, it is a principal object of this invention to provide a process for the recovery of uranyl uranium from solutions by liquid-liquid solvent extraction which eliminates the problems of the prior art set forth above.

SUMMARY OF THE INVENTION

The invention is an improvement in the recovery of uranyl uranium from solution by liquid-liquid solvent extraction (ion exchange) in which the uranium is stripped from the ion exchange agent with an alkali metal carbonate rather than ammonium carbonate, the loaded agent is scrubbed with alkali metal carbonate strip solution which has been acidified and the stripped ion exchange agent is regenerated with sulfuric acid before return to the ion exchange circuit.

DESCRIPTION OF THE PREFERRED EMBODIMENTS

The invention will now be described with reference to the illustrative examples which follow. The results recorded below were obtained from a two circuit process using as a feed a wet-process phosphoric acid as disclosed in the above mentioned copending patent application. In accordance with that process the uranium in the feed solution was reduced to the uranous form, recovered from the solution with liquid-liquid solvent extraction (ion exchange) agent for uranous uranium and stripped from the agent in an oxidative strip with phosphoric acid containing hydrogen peroxide as the oxidizing agent. The test results below illustrating the improvements which constitute this invention, that is, the novel scrubbing, stripping and regeneration features, were obtained using the oxidative phosphoric acid strip solution from the first circuit. The wet-process feed phosphoric acid had a chemical profile typified by the following analysis. A typical feed solution received from a wet-process plant is as follows:

$U_3O_8$, gpl: 0.140
emf, mv: −260
Total Fe, gpl: 4.1
$Fe^{+2}$, gpl: 0.47
$H_3PO_4$%: 39.1
Specific Gravity: 1.3085

The feed was processed through the first liquid-liquid solvent extraction circuit and the phosphoric acid stripping circuit to provide an aqueous strip solution containing the uranium in uranyl form from which the results in the following examples were obtained.

Before stripping the oxidized uranium loaded on the liquid-liquid solvent extraction agent DEHPA in synergistic combination with trioctylphosphine oxide (TOPO), or di-butyl butylphosphonate (DBBP), or tributylphosphate (TBP), the agent and solvent were scrubbed to remove impurities such as phosphorus, iron, and others. Water which was used as a scrubbing agent in the prior art was found to be inadequate for removing metal impurities which, if not removed, end up as contaminants in the final uranium oxide product. The oxidized uranium on the scrubbed agent was stripped with sodium carbonate. The strip solution was then acidified with sulfuric acid to remove all carbonate. Part of this acidified strip solution was recycled to scrub phosphorus and other impurities before the uranium is stripped off with sodium carbonate.

In order to test the effectiveness of acidified sodium carbonate strip concentrate as a scrubbing agent, comparative tests were made with various scrubbing agents. The results are summarized in the following table.

TABLE 1

| Test No. | Scrub Solution | Metals in Organic Phase $H_3PO_4$, gpl Loaded Organic | $H_3PO_4$, gpl Scrubbed Organic | Fe, gpl Loaded Organic | Fe, gpl Scrubbed Organic | $U_3O_8$, gpl Loaded Organic | $U_3O_8$, gpl Scrubbed Organic |
|---|---|---|---|---|---|---|---|
| 1 | Water | 1.0 | 0.38 | — | 0.014 | 9.26 | 9.12 |
| 2 | IN $H_2SO_4$ | 1.0 | 0.25 | 0.018 | 0.017 | 9.4 | 9.3 |
| 3. | Acidified $U_3O_8$ strip concentrate | 0.8 | 0.05 | 0.048 | 0.041 | 9.0 | 19.4 |
| 4 | Same | 0.8 | 0.06 | 0.045 | 0.044 | 9.3 | 19.0 |

Tests 3 and 4 show the effectiveness of the acidified strip concentrate in reducing the amount of phosphoric acid on the loaded organic. In these tests, the phosphate ion was reduced from 0.8 to 0.05 gpl in test 4 and 0.06 gpl in test 5. These results are much superior to those obtained with the other scrub solutions.

The use of acidified strip solution, in addition to the simple scrubbing to remove entrained impurities, provides a high concentration of uranium that is sufficient to saturate the liquid-liquid solvent extraction agent with respect to uranium. The increased loading of uranium on the agent displaces other metal impurities and an additional purification step is realized. The specific affinity of the liquid-liquid solvent extraction agent for uranium allows the uranium to load and displace the other impurities. Table 1 (tests 3 and 4) shows the ratio of uranium to iron to be 197 in the loaded organic as compared to 451 in the scrubbed organic.

The stripping agent used is sodium carbonate rather than the ammonium carbonate of the prior art. An advantage of using sodium carbonate over ammonium carbonate is that sodium carbonate solution produces a totally soluble strip concentrate solution at a materially higher concentration of uranium. This concentrate can then be treated in an external system for the precipiation of uranium and recycle of filtrate. Use of sodium carbonate solution eliminates the problem of organic wetting of the yellow cake product which occurs when ammonium carbonate is used as a stripping agent. Use of sodium carbonate maintains the solution at a high final pH so that all potential precipitates remain soluble in the strip concentrate, thus eliminating solids accumulation in the strip circuit.

Tests were conducted to show the efficiency of sodium carbonate as a stripping agent. The sodium carbonate solution contained 150 gpl $Na_2CO_3$. Conventional stripping procedure was used. Representative results are presented in Table 2 below.

TABLE 2

| Test No. | Scrubbed Organic $U_3O_8$ gpl | Strip O/A Ratio | $U_3O_8$ in Strip Concentrate gpl | Stripped Organic gpl $U_3O_8$ |
|---|---|---|---|---|
| 1 | 20.0 | 2.0 | 51.4 | 0.04 |
| 2 | 19.4 | 2.0 | 48.2 | 0.03 |
| 3— | 19.0 | 2.0 | 48.4 | 0.05 |

The goal of about 50 grams per liter $U_3O_8$ in the strip concentrate was achieved. The high pH value (8 and above) obtained in the stripped concentrate eliminated any solid accumulation in the mixer-settlers. This, of course, is an advantage of sodium carbonate as a stripping agent over ammonium carbonate.

It was found that sodium carbonate strip contact time and the concentration of the sodium carbonate strip solution were important variables for efficient stripping. Results obtained using 75 gpl and 100 gpl sodium carbonate strip solutions are set forth in the following table.

TABLE 3

| Cumulative Contact Time Min. | 75-gpl $Na_2CO_3$ (O/A = 3) Stripped Organic $U_3O_8$ gpl | 75-gpl $Na_2CO_3$ (O/A = 3) $U_3O_8$ Stripped % | 100 gpl $Na_2CO_3$ (O/A = 2) Stripped Organic $U_3O_8$ gpl | 100 gpl $Na_2CO_3$ (O/A = 2) $U_3O_8$ Stripped % |
|---|---|---|---|---|
| 1 | 2.78 | 67.7 | 0.28 | 96.9 |
| 2 | 2.36 | 72.6 | 0.28 | 96.9 |
| 3 | 1.86 | 78.4 | 0.28 | 96.9 |
| 4 | 1.42 | 83.5 | 0.28 | 96.9 |
| 5 | 1.00 | 88.4 | 0.28 | 96.9 |
| Loaded Organic Feed, gpl | 8.60 | — | 9.00 | — |

From the results it can be seen that at least five minutes with the use of a 75 gpl $Na_2CO_3$ at an organic to aqueous ratio of 3 would be required but with 100 gpl sodium carbonate strip solution effective stripping is accomplished at an organic to aqueous ratio of 2 in one minute.

It was found that recycle of the stripped DEHPA-TOPO agent without further treatment resulted in serious phase separation problems in the second circuit. An initial run was set up without an acid regeneration step on the stripped agent. It was found that appreciable emulsion accumulated in the extraction section within the first two hours of operation. Spot analysis of the feed and the raffinate indicated that silica hydrolysis equivalent to about 5.5 gpl silicon dioxide had occurred during extraction. This was caused by the alkalinity of the incoming stripped DEHPA-TOPO agent.

Emulsion in the extraction circuit occurred when an excess of sodium was introduced with the DEHPA-TOPO organic agent. Sodium from the sodium carbonate strip circuit became entrained in the organic solvent carrying the DEHPA-TOPO agent. It was found that the problem could be eliminated by conducting an acid regeneration step on the organic agent before recycling. By contacting the agent organic with dilute sulfuric acid, the excess sodium entrained in the agent organic was removed and the DEHPA-TOPO agent was converted from the sodium to the acid form. Emulsion formation in the second circuit was eliminated.

In order to summarize the results as shown in the successful operation of the second circuit, the following analytical profile data of the second circuit is provided in Table 4.

TABLE 4

Analytical Profile Data of the Second Circuit

Extraction Circuit (O/A = 1)

| Stage No. | $U_3O_8$, gpl Raffinate | $U_3O_8$, gpl Organic | $U_3O_8$ Extraction % |
|---|---|---|---|
| E-1 | 3.20 | 9.00 | 64.8 |
| E-2 | 1.10 | 3.10 | 87.9 |
| E-3 | 0.25 | 1.00 | 97.2 |
| E-4 | 0.13 | 0.15 | 98.3 |
| Aqueous Feed | 9.1 | — | — |

Scrubbing Circuit (O/A = 3)
(49.7 gpl $U_3O_8$ in Scrubbing Solution, pH 1.8)

| Stage No. | Aqueous Phase $H_3PO_4$ gpl | Aqueous Phase $U_3O_8$ gpl | Organic Phase $H_3PO_4$ gpl | Organic Phase $U_3O_8$ gpl |
|---|---|---|---|---|
| SC-1 | 3.77 | 0.005 | — | 9.16 |
| SC-2 | 0.12 | 0.019 | — | 11.4 |
| SC-3 | 0.02 | 0.27 | 0.08 | 19.4 |
| Loaded Organic | — | — | 0.80 | 9.0 |

Stripping Circuit (O/A = 2 to 2.08)

| Stage No. | Aqueous Phase $U_3O_8$ gpl | Organic Phase $U_3O_8$ gpl | Equilibrium pH | $U_3O_8$ Stripped % |
|---|---|---|---|---|
| S-1 | 48.2 | 1.10 | 9.3 | 94.3 |
| S-2 | 10.0 | 0.25 | 10.2 | 98.7 |
| S-3 | 3.4 | 0.03 | 10.7 | 99.8 |
| Loaded Organic | — | 19.4 | — | — |

Solvent Regeneration Circuit O/A = 1.5)

| Stage No. | Aqueous Phase $U_3O_8$ gpl | Aqueous Phase $H_2SO_4$ gpl |
|---|---|---|
| R-1 | 0.004 | 16.0 |

A representative sample of pregnant sodium carbonate strip solution was processed for recovery of uranium oxide. In a typical processing, the strip solution was neutralized to a pH of about 6.5 with $H_2SO_4$ and filtered for iron, vanadium and other contaminant removal. The filtrate was acidified with sulfuric acid to pH 1.85 to facilitate carbon dioxide removal. Yellow cake was precipitated by effecting a pH change in the acidified pregnant strip solution to about 7.5–8.0 with anhydrous ammonia. The analysis of the yellow cake product is set forth in the following table.

TABLE 5

Yellow Cake Product Analysis

| Item | Product 1 (1.0 liter of solution filtered at pH 6.5) | Product 2 (1.0 liter of solution not filtered) |
|---|---|---|
| Dry Yellow Cake Weight, gm | 54.4 | 55.5 |
| Dry Residue Weight at pH 6.5, gm | 1.0 | |
| Yellow Cake Analysis, | | |
| % $U_3O_8$ | 85.6 | 84.7 |
| Na | 4.8 | 4.9 |

TABLE 5-continued

Yellow Cake Product Analysis

| Item | Product 1 (1.0 liter of solution filtered at pH 6.5) | Product 2 (1.0 liter of solution not filtered) |
|---|---|---|
| Fe | 0.012 | 0.25 |
| PO | 0.06 | 0.24 |
| $V_2O_5$ | 0.06 | 0.08 |

The yellow cake analysis is within maximum impurity limits.

The slurry obtained by the precipitation of uranium is sent to a thickener for the initial solid-liquid separation. The solution overflowing the thickener can be reconstituted by the addition of sodium carbonate for recycle to the strip circuit. The thickened yellow cake product is further densified and washed by centrifuge and calcined to produce the final uranium oxide product.

A preferred concentration for the sodium carbonate stripping agent is from about 50–200 gpl sodium carbonate, a preferred stripping contact time is about ½–5 minutes, and a preferred organic to aqueous ratio is about 0.5–1.0. Other alkali metal carbonates may be used, such as potassium carbonate and lithium carbonate. An equilibrium pH of about 8 to 10 for the alkali metal carbonate solution is preferred. Other mineral acids than sulfuric acid, such as nitric acid and hydrochloric acid, may be used to regenerate the agent prior to return to the circuit.

What is claimed is:

1. The process for recovering uranyl uranium from an acid solution containing phosphate ions which comprises (a) recovering the uranyl uranium from the solution by liquid-liquid solvent extraction with di(2-ethylhexyl)phosphoric acid to which has been added a synergistic concentration of a member selected from the group consisting of trioctylphosphine oxide, dibutyl butylphosphonate, and tributylphosphate;

(b) stripping the uranium from the uranium loaded extraction agent with sodium carbonate having a pH between about 8–10;

(c) neutralizing the uranium loaded strip solution to a pH of about 6.5 with sulfuric acid to precipitate iron, vanadium and other impurities;

(d) removing precipitated solids and other solids from the solution of (c); and (e) recovering uranium as yellow cake from the solution of (d).

2. The process of claim 1 in which the sodium carbonate strip solution contains about 50–200 g/l sodium carbonate, a stripping time of about 0.5–5 minutes is used and the preferred organic to aqueous ratio is about 0.5–1.

3. The process of claim 1 in which the stripped organic is neutralized with sulfuric acid to remove entrained sodium and recycled to step (a); whereby the solvent extraction agent is regenerated and the formation of emulsions in the extraction circuit due to the presence of sodium is prevented.

* * * * *